US006603374B1

(12) United States Patent
Goertz et al.

(10) Patent No.: US 6,603,374 B1
(45) Date of Patent: Aug. 5, 2003

(54) WAVEGUIDE RESONATOR DEVICE AND FILTER STRUCTURE PROVIDED THEREWITH

(75) Inventors: Franz-Josef Goertz, Burgstetten (DE); Dietmar Schmitt, Kleinaspach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 08/675,938

(22) Filed: Jul. 5, 1996

(30) Foreign Application Priority Data

Jul. 6, 1995 (DE) ..... 195 24 633

(51) Int. Cl.[7] ..... H01P 7/10; H01P 1/20; H01P 1/207

(52) U.S. Cl. ..... 333/219.1; 333/202; 333/208; 333/234; 333/995

(58) Field of Search ..... 333/202, 202 DR, 333/208, 219.1, 234, 995

(56) References Cited

U.S. PATENT DOCUMENTS

| | | | | |
|---|---|---|---|---|
| 2,863,127 A | | 12/1958 | Albersheim | 333/24.3 |
| 4,241,322 A | | 12/1980 | Johnson et al. | 333/202 |
| 4,609,883 A | | 9/1986 | Mizumura | 331/96 |
| 4,661,790 A | | 4/1987 | Gannon et al. | 333/234 |
| 4,896,125 A | | 1/1990 | Blair, Jr. et al. | 333/219.1 |
| 4,939,489 A | * | 7/1990 | Gueble et al. | 333/219.1 X |
| 5,008,640 A | * | 4/1991 | Accatino et al. | 333/219.1 |
| 5,027,090 A | * | 6/1991 | Gueble et al. | 333/219.1 X |
| 5,034,711 A | * | 7/1991 | Hendrick et al. | 333/219.1 |
| 5,324,713 A | * | 6/1994 | Shen | 333/219.1 X |
| 5,457,087 A | * | 10/1995 | Dorothy et al. | 333/219.1 X |

FOREIGN PATENT DOCUMENTS

| | | | | |
|---|---|---|---|---|
| DE | 21 04 311 B | | 8/1972 | |
| EP | 0 104 735 A2 | | 4/1984 | |
| EP | 0 328 948 A1 | | 8/1989 | |
| EP | 0 438 807 B1 | | 11/1994 | |
| EP | 0 351 840 B1 | | 1/1995 | |
| GB | 2 276 039 A | * | 9/1994 | 333/202 DR |

* cited by examiner

*Primary Examiner*—Barbara Summons
(74) *Attorney, Agent, or Firm*—Michael J. Striker

(57) ABSTRACT

For fixing a dielectric insert in a waveguide, clamping bodies are provided which contact the dielectric insert on its outer periphery only tangentially. The dielectric insert is fixed in a wave propagation direction by a supporting element. In a further embodiment, the dielectric insert is rigidly mounted on the supporting element. As a result thermal stresses can be absorbed.

7 Claims, 3 Drawing Sheets

FIG. 3
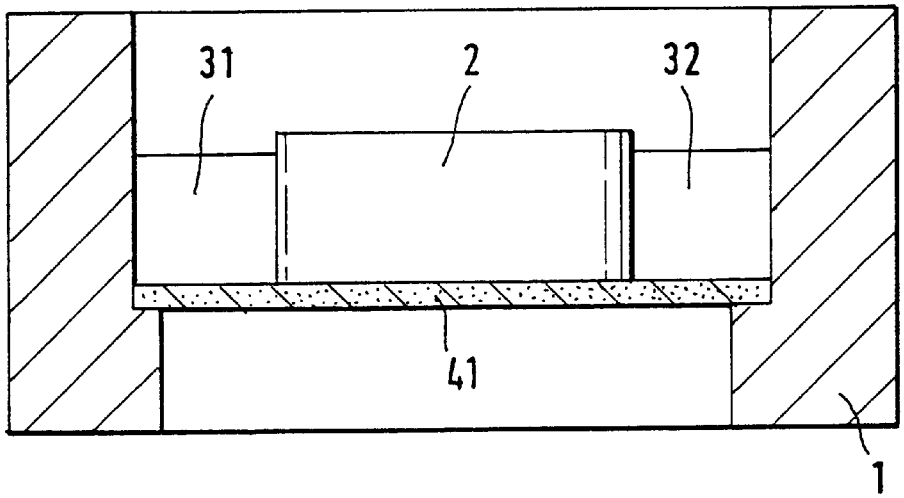
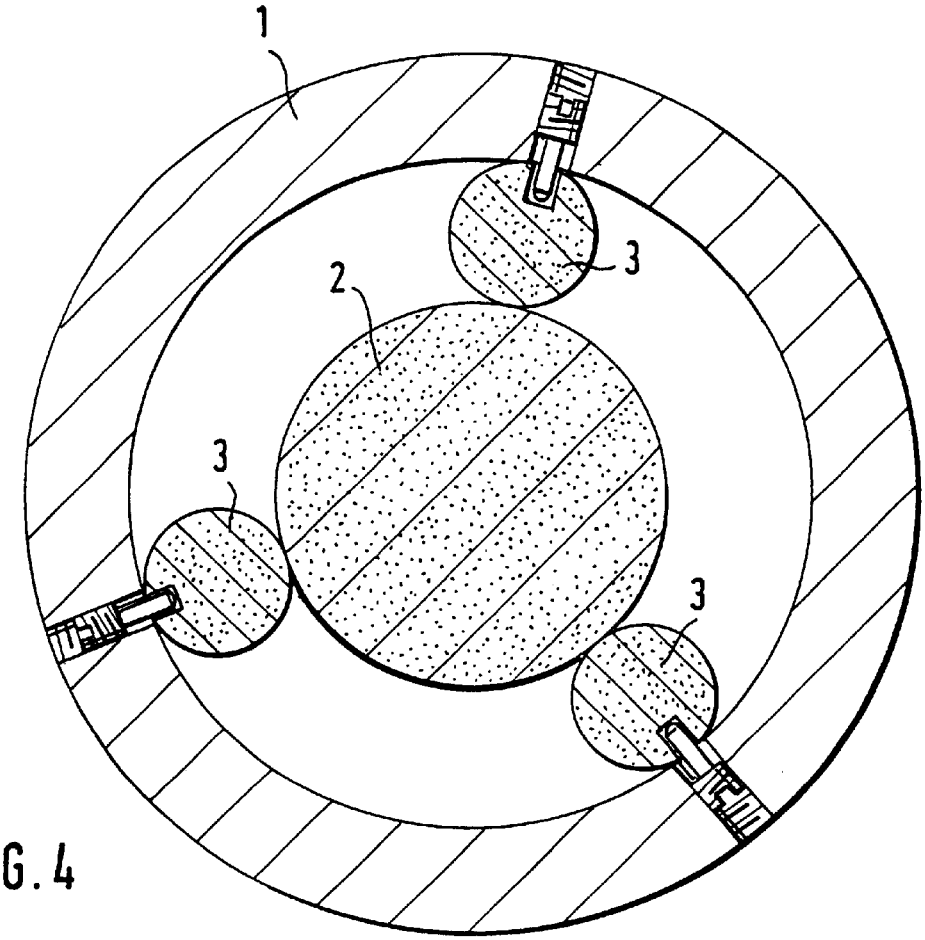
FIG. 4

WAVEGUIDE RESONATOR DEVICE AND FILTER STRUCTURE PROVIDED THEREWITH

BACKGROUND OF THE INVENTION

The present invention relates to a wave guide resonator device and a filter structure provided therewith.

The European Patent Document EP 438 807 B1 discloses a waveguide resonator device in which a plurality of supporting bars are provided for centrally fixing a dielectric in the waveguide. The supporting bars are mounted on the waveguide and introduced in the dielectric insert through corresponding openings on its outer periphery.

The European Patent Document EP 351 840 A2 discloses a resonator with the dielectric insert. The insert is held by two plates provided with special centering devices. The embracing of the insert by the centering device can cause thermal stresses.

The European Patent Document EP 104 735 B1 discloses a waveguide resonator with tuning screws facing in direction of the dielectric insert. The European Patent Document EP 328 948 B1 discloses a dielectric waveguide resonator in which the dielectric insert is centrally fixable in a chuck system adjustable by three screws in the waveguide. The U.S. Pat. No. 3,155,965 discloses a supporting structure for a ferrite body in a hollow guide with radial supporting pins mounted on the periphery of the ferrite body.

SUMMARY OF THE INVENTION

Accordingly, it is an object of the present invention to provide a waveguide resonator device, which avoids the disadvantages of the prior art.

In keeping with these objects and with others which will become apparent hereinafter, one feature of the present invention resides, briefly stated, in a waveguide resonator device, which has a waveguide, a dielectric insert inside a waveguide, several clamping bodies for fixing the dielectric insert inside the waveguide, the clamping bodies being arranged between the waveguide and an outer periphery of the dielectric insert and contracting the dielectric insert only tangentially, at least one supporting element for the dielectric insert for fixing it in a direction deviating from the fixing direction of the dielectric insert by the clamping body.

When the waveguide resonator device is designed in accordance with the present invention, thermal stresses are better absorbed than in the known arrangements since no special mountings are needed. The device in accordance with the present invention is easy to manufacture. No openings must be provided in the dielectric insert as in the device disclosed in the European Patent Document EP 438 807 B1. An expensive chuck system disclosed in the European Patent Document EP 328 948 B1 also is not needed. Despite this, a very accurate fixing/holding of the dielectric insert in the wave propagation direction of the waveguide (hollow guide) is possible, due to the supporting element and also perpendicular to wave propagation direction in a transverse plane, without unfavorably affecting the thermal stresses. Since no changes must be performed in the dielectric insert (mountings, openings, etc.) no interference points are formed which can worsen the resonator quality. With the features of the present invention, any dielectric inserts can be selected, such as for example balls, cylinders, without changing the holding device. The dielectric inserts of different geometry can be exchanged, for example the cylinder can be exchanged with the ball and vice versa. Thereby the arrangement in accordance with the present invention can be used universally and suitable for different applications, for example different filter structures, multi-mode filters, etc. The supporting element has no centering means which can lead to unfavorable thermal stresses.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view showing longitudinal section of the inventive embodiment of FIG. 2;

FIG. 4 is a view showing a transverse section through the waveguide with the dielectric insert in accordance with a further embodiment of the clamping body;

DESCRIPTION OF PREFERRED EMBODIMENTS

Figure 1:
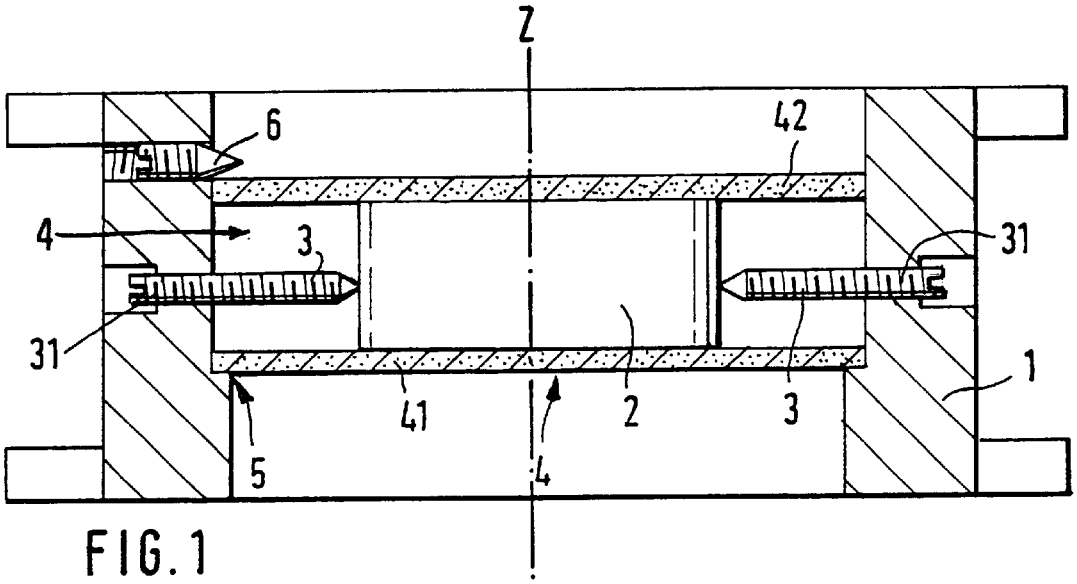
FIG. 1 is a view showing the longitudinal section of a waveguide with a dielectric insert in accordance with the present invention.

FIG. 1 shows a waveguide resonator device which has a waveguide 1 formed for example as a round hollow guide resonator with a dielectric insert 2 arranged preferably in the center of the hollow guide. The dielectric insert is formed in the embodiment of FIG. 1 as a disk-shaped cylinder. In a not shown embodiment, the dielectric insert can be also spherical. The dielectric insert 2 is composed for example of a dielectric ceramic with a high dielectricity constant, for example 10–50. Thereby the resonators with high grade and low permitivity can be provided.

Several clamping bodies 3 are arranged between an outer periphery of the dielectric insert, or in other words between the cylindrical surface, and the hollow guide 1. They extend radially relative to the clamping body 3 and contact it only tangentially. In the embodiment shown in FIG. 1 the clamping bodies 3 are formed as transverse bars. These bars are preferably uniformly distributed in one plane and can be adjusted by threaded screws 31 in the waveguide 1 in direction toward the dielectric insert 3 to provide a desired clamping pressure as well as the desired position (here a central position of the dielectric insert in the hollow guide 1). For example, three clamping bodies 3 are arranged so that they are spaced from one another by 120°.

For fixing the dielectric insert 3 in a direction (here z-direction) which deviates from the fixing direction or directions (here x-direction and y-direction in a transverse plane of the hollow guide) of the dielectric 2 by the clamping bodies 3, a supporting element is provided. The supporting element is composed in the shown embodiment of two plates 41 and 42. The plate 41 abuts against a projection 5 in the waveguide 1, which forms a diameter projection in the waveguide. The plate 42 is located on the opposite surface of the cylindrical dielectric insert 2. A clamping element 6 is associated with the plate 42 and can be formed, for example, as a headless clamping screw for adjusting the plate 42 in direction of the plate 41. The dielectric insert is fixable in z-direction by the supporting element. With a sufficient clamping pressure through the clamping body 3, the upper plate 42 can be dispensed with. In the event of higher acceleration loads of the arrangement in accordance with the present invention, for example for the insert in satellites, the second plate 42 is usually needed for mechanical reasons. The plate or plates 41, 42 are preferably composed of quartz for thermal reasons. The plates 41 and 42 preferably do not have any centering devices, such as steps, webs, etc., which can lead to unfavorable thermal stresses.

Figure 2:
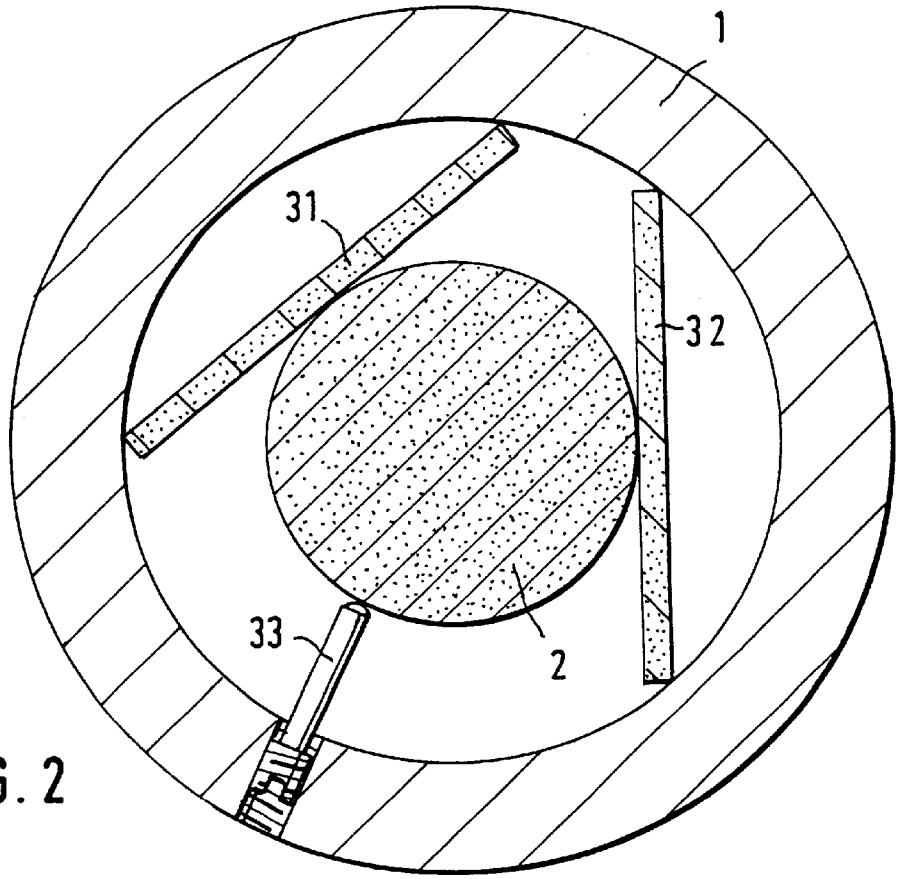
FIG. 2 is a view showing a transverse section through the waveguide with the dielectric insert and differently designed clamping bodies.

FIG. 2 shows a cross-section through the round hollow guide 1 with a different embodiment of the clamping body 3. Here, the clamping bodies 31 and 32 are formed as plates extending transversely in the hollow guide 1 and composed for example of quartz or ceramic. They contact the dielectric insert 2 tangentially. The third clamping body 33 is formed as a bar, which is adjustable by a screw on the dielectric insert and is suitable for adjustment of the required clamping pressure. FIG. 3 shows a longitudinal section of the device in accordance with this embodiment.

In a further embodiment shown in FIG. 4, the clamping body 3 is formed as circular cylinders or balls which are adjustable by headless screws radially in direction of the dielectric insert 2. In this embodiment the clamping body 3 contacts the circularly cylindrical dielectric insert or spherical dielectric insert 2 only tangentially.

In accordance with a further embodiment of the present invention, the supporting element can be formed as at least one further clamping body, which is suitable for applying a clamping action to the dielectric insert 2 in an axial direction. This direction deviates from the orientation for fixing the dielectric insert 2 by the clamping body 3.

Figure 5:
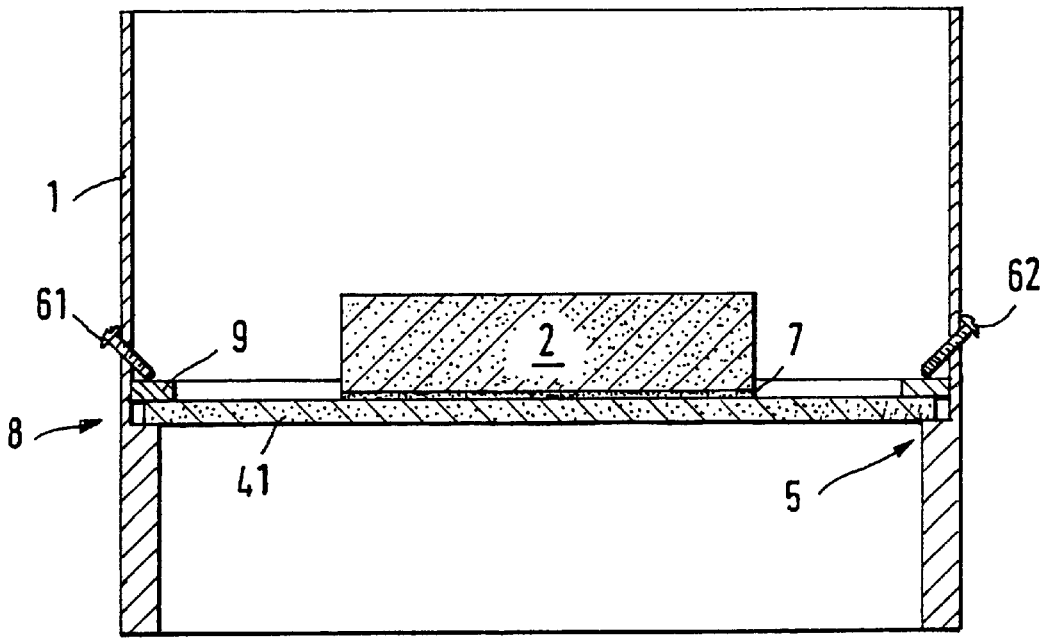
FIG. 5 is a view showing the longitudinal section through the waveguide with gluing of the insert on the supporting plate.

In accordance with a further embodiment of the present invention shown in FIG. 5, the dielectric 2 which is cylinder-shaped is mechanically fixed relative to the supporting element formed by the plate 41. The plate 41 is supported on its outer periphery in a holder 8 which is mounted on the inner edge of the waveguide 1. The fixing of the insert 2 on the plate 41 is performed flatly, for example through a suitable adhesive 7 with high thermal conductivity. By glueing the insert 2 on the plate 41, the clamping body 3 is not necessary for fixing. However, it has been used for additional heat withdrawal. The plate 41 is composed of an electrically low-conductive material which is, for example, high heat conducted. The materials to be used here can be diamond or sapphire. Because of the flat fixation as well as because of the high thermal conductivity of the plate 41, good heat withdrawal from the dielectric insert 2 to the waveguide outer wall/resonator wall is obtained and therefore the loss energy produced in the dielectric is withdrawn fast.

The projection 5 in the waveguide 1 can be used as the holder 8, so that the plate 41 can be pressed by a clamping element against it. The clamping element can be formed, for example, by non-metallic screws 61, 62 composed of synthetic plastic material. They are guided at an angle of substantially 45° in the hollow guide wall 1 and press the plate 41 against the projection 5. As shown in FIG. 5, a ring 9 can be provided between the screws 61, 62 which are uniformly distributed on the plate edge, and the plate 41. The ring provides a uniform pressure application. By means of the screws 61, 62 and the ring 9, the position of the plate 41 perpendicular to the wave propagation direction/axial direction of the insert 2 can be adjusted and inaccuracies of glueing of the insert 2 with the plate 41 can be compensated to provide centering. Such a centering can be performed by screws or pins adjustable perpendicular to the hollow guide 1 on the plate 41.

Figure 6:
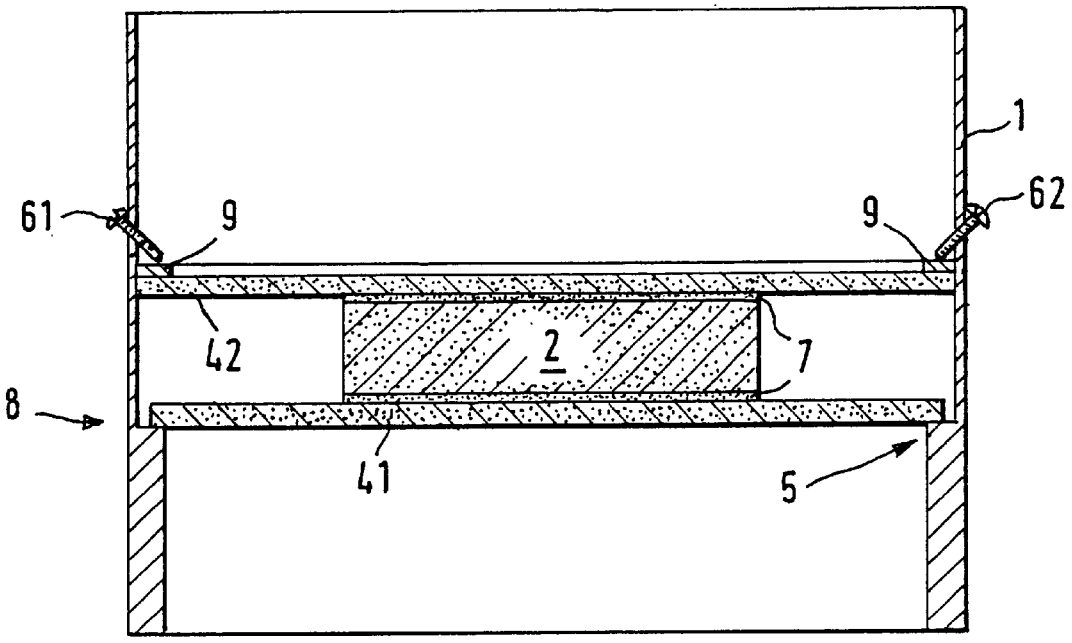
FIG. 6 is a view showing longitudinal section of a further supporting plate in accordance with the present invention.

In the embodiment of FIG. 6, the supporting element 4 is formed as a further plate 42 which is glued in particular on the dielectric insert. Thereby the heat withdrawal can be further increased. The plate 42 can be provided with a similar holder as described above. Also, additional clamping bodies 3 formed as pins, cylinders, etc. and composed of a high heat conductive or electrically low conductive material, such as diamond or sapphire, can be provided for further heat withdrawal. They contact the outer surface of the insert 2 tangentially. In particular, these clamping bodies can be glued with the insert 2 in a heat conductive manner.

As an alternative for mounting the screws, the plate 41 and/or the plate 42 can be coated on the outer edge with solderable material so that the plate 41 and 42 can be soldered on the projection 5 and/or on the inner wall of the waveguide. In the same way, the dielectric insert 2 can be soldered on the plate 41 or 42 when a corresponding metallization is provided beforehand.

At least one clamping body 3, the supporting element 4, the inner wall of the hollow guide, the dielectric insert 2 and/or the further clamping body can be completely or partially coated with a superconductor. In this way the losses can be reduced and the resonator quality can be increased.

Filter structures can be formed with the waveguide resonator device in accordance with the present invention, for example by setting the above-mentioned structures on one another in a waveguide. Also, a multi-mode filter can be produced, which can be used as a channel multiplexer. Since the mounting of the supporting element or plate/plates is performed only through the hollow guide wall in the waveguide propagation direction (z-direction) a resonator coupling/tuning in z-direction is possible without problems.

It will be understood that each of the elements described above, or two or more together, may also find a useful application in other types of constructions differing from the types described above.

While the invention has been illustrated and described as embodied in waveguide resonator device and filter structure provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A waveguide-resonator device, comprising a waveguide; a dielectric insert arranged inside said waveguide; a plurality of clamping bodies for fixing said dielectric insert inside said waveguide in a fixing direction, said clamping bodies being arranged between said waveguide and an outer periphery of said dielectric insert and contacting said dielectric insert only tangentially; and a supporting element for fixing said dielectric insert in a direction which deviates from said fixing direction of said dielectric insert by said clamping bodies, said clamping bodies being formed as balls.

2. A waveguide-resonator device, comprising a waveguide; a dielectric insert arranged inside said waveguide; a plurality of clamping bodies for fixing said dielectric insert inside said waveguide in a fixing direction, said clamping bodies being arranged between said waveguide and an outer periphery of said dielectric insert and contacting said dielectric insert only tangentially; and a supporting element for fixing said dielectric insert in a direction which deviates from said fixing direction of said dielectric insert by said clamping bodies, said clamping bodies being formed as plates.

3. A waveguide-resonator device, comprising a waveguide; a dielectric insert arranged inside said waveguide; a plurality of clamping bodies for fixing said dielectric insert inside said waveguide in a fixing direction, said clamping bodies being arranged between said waveguide and an outer periphery of said dielectric insert and contacting said dielectric insert only tangentially; and a supporting element for fixing said dielectric insert in a direction which deviates from said fixing direction of said dielectric insert by said clamping bodies, said supporting element including two plates between which said dielectric insert is fixable in a direction extending perpendicular to said fixing direction in which the dielectric insert is fixed by said clamping bodies, said waveguide having a projection formed in direction of its diameter, at least one of said plates abutting against said projection.

4. A waveguide-resonator device, comprising a waveguide; a dielectric insert arranged inside said waveguide; a plurality of clamping bodies for fixing said dielectric insert inside said waveguide in a fixing direction, said clamping bodies being arranged between said waveguide and an outer periphery of said dielectric insert and contacting said dielectric insert only tangentially; and a supporting element for fixing said dielectric insert in a direction which deviates from said fixing direction of said dielectric insert by said clamping bodies, said supporting element including two plates between which said dielectric insert is fixable in a direction extending perpendicular to said fixing direction in which the dielectric insert is fixed by said clamping bodies, said supporting element having an outer edge coated with a solderable material so that it is soldered to said waveguide.

5. A waveguide-resonator device, comprising a waveguide; a dielectric insert arranged inside said waveguide; a plurality of clamping bodies for fixing said dielectric insert inside said waveguide in a fixing direction, said clamping bodies being arranged between said waveguide and an outer periphery of said dielectric insert and contacting said dielectric insert only tangentially; and a supporting element for fixing said dielectric insert in a direction which deviates from said fixing direction of said dielectric insert by said clamping bodies, at least one of said clamping bodies being mounted on said waveguide so that a changeable clamping pressure relative to said dielectric insert is adjustable, said supporting element including two plates between which said dielectric insert is fixable in a direction extending perpendicular to said fixing direction in which said dielectric insert is fixed by said clamping bodies, said waveguide having a projection formed in direction of its diameter, at least one of said plates abutting against said projection; and pressing means associated with said at least one plate and pressing said at least one plate against said projection.

6. A waveguide-resonator device as defined in claim 5; and further comprising clamping means which adjust another of said plates in direction towards said first mentioned plate abutting against said projection.

7. A waveguide-resonator device as defined in claim 6, wherein said clamping means includes screws which are adjustable at an angle of substantially 45° relative to said supporting element.

* * * * *